United States Patent [19]

Yano et al.

[11] Patent Number: 4,574,872

[45] Date of Patent: Mar. 11, 1986

[54] HEAT EXCHANGER APPARATUS

[75] Inventors: Nobuyuki Yano, Hirakata; Takuro Kotera, Kawanishi; Toshio Utagawa, Hirakata; Akira Aoki, Kasugai; Kazufumi Watanabe, Aichi; Masao Wakai, Kasugai, all of Japan

[73] Assignee: Matsushita Electric Industrial Co., Ltd., Osaka, Japan

[21] Appl. No.: 629,844

[22] PCT Filed: Nov. 2, 1983

[86] PCT No.: PCT/JP83/00392

§ 371 Date: Jul. 3, 1984

§ 102(e) Date: Jul. 3, 1984

[87] PCT Pub. No.: WO84/01817

PCT Pub. Date: May 10, 1984

[30] Foreign Application Priority Data

| | | | |
|---|---|---|---|
| Nov. 4, 1982 | [JP] | Japan | 57-194119 |
| Nov. 4, 1982 | [JP] | Japan | 57-194120 |
| Nov. 17, 1982 | [JP] | Japan | 57-202750 |
| Dec. 17, 1982 | [JP] | Japan | 57-222780 |
| Dec. 17, 1982 | [JP] | Japan | 57-222781 |
| Jan. 11, 1983 | [JP] | Japan | 58-2437 |

[51] Int. Cl.[4] ..... F28D 19/00

[52] U.S. Cl. ..... 165/8; 165/10; 165/54; 165/86; 55/390

[58] Field of Search ..... 165/86, 97, 88, 92, 165/125, 166, 8, 10, 54; 55/390

[56] References Cited

FOREIGN PATENT DOCUMENTS 146987 11/1981 Japan ..... 165/88

*Primary Examiner*—Albert W. Davis, Jr.

*Attorney, Agent, or Firm*—Spencer & Frank

[57] ABSTRACT

A heat exchanger apparatus includes a cylindrical-shaped heat exchanger formed by alternately laminating first and second elements in the circumferential direction of the cylindrical-shaped heat exchanger. The cylindrical-shaped heat exchanger is rotated to carry out the function of the conventional regenerative rotary type total heat exchanger. In addition, the first and second elements are also allowed to effect a heat exchange or total heat exchange operation. The cylindrical-shaped heat exchanger is either hollow or solid, which provides many variations in arrangement of air ducts for primary and secondary air flows. Further, a partition interposed between the first and second elements has variation in property: permeable to water vapor; non-permeable to water vapor as well as non-hygroscopic; and so forth. The first and second elements exchange heat with each other in a total heat exchange operation mode and a sensible heat exchange operation mode.

7 Claims, 24 Drawing Figures

HEAT EXCHANGER APPARATUS

TECHNICAL FIELD

The present invention relates to a heat exchanger apparatus which may suitably be applied to an air-conditioning ventilation system, for example, for heat exchanging ventilation such as supply of outdoor air and expelling of indoor air. More particularly, the invention pertains to a heat exchanger apparatus which includes a cylindrical-shaped heat exchanger formed by alternately laminating first and second elements in the circumferential direction of the cylindrical-shaped heat exchanger. A partition interposed between the first and second elements is constituted by a material having heat transfer properties. One of the elements is employed as a primary air flow passage, while the other element is employed as a secondary air flow passage. The primary and secondary air flow passages are periodically switched over from one to the other by rotating the cylindrical-shaped heat exchanger.

BACKGROUND ART

Examples of the plate-type heat exchanger element conventionally employed for an air-conditioning ventilation fan include a total heat exchanger element which employs as its partition a material having heat transfer properties and permeability to water vapor, such as paper, and a sensible heat exchanger element which employs as its partition a heat-conducting substance that is non-permeable to water vapor, such as a metal or plastic. These conventional heat exchanger elements are generally low in efficiency, since these heat exchanger elements effect a total heat exchange operation or sensible heat exchange operation through the partitions between a supply air flow and an exhaust air flow which continuously pass simultaneously and alternately through their respective layers defined by the partitions of the heat exchanger elements in their respective fixed directions.

On the other hand, in the case of a regenerative rotary type heat exchange operation making use of the accumulation of heat and moisture in a cylindrical-shaped heat exchanger, the cylindrical-shaped heat exchanger is generally required to rotate at a number of revolutions of about 15 r.p.m. since such heat exchanger has a small heat accumulation capacity. For this reason, noise is easily generated by the rotation of the cylindrical-shaped heat exchanger. Further, in the total heat exchange operation, the effective quantity of water vapor adsorbed by the elements constituting the cylindrical-shaped heat exchanger is disadvantageously reduced due to the influence on the cylindrical-shaped heat exchanger of the accumulated sensible heat, the heat of adsorption and the heat of desorption.

SUMMARY OF THE INVENTION

The present invention aims at obtaining a heat exchange efficiency higher than that of the prior art in such a manner that primary and secondary air flows which adjacently pass through their respective layers defined by heat-transfer partitions as constituent members of heat exchanger elements are periodically switched over from one to the other by rotating the cylindrical-shaped heat exchanger.

Further, in the case where a partition interposed between the adjacent elements constituting the cylindrical-shaped heat exchanger is non-permeable to water vapor and yet hygroscopic, it is possible to provide a completely novel and highly efficient heat exchanger apparatus.

BEST MODE FOR CARRYING OUT THE INVENTION

Preferred embodiments of the invention will be described hereinunder with reference to the accompanying drawings.

Figure 1:
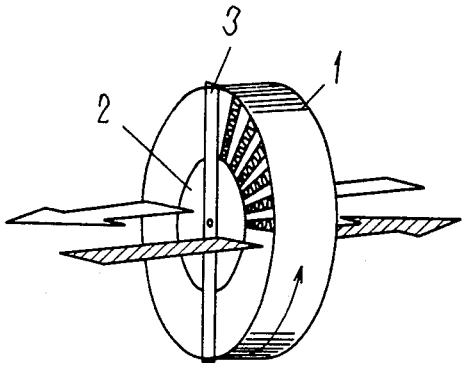
FIG. 1 is a schematic illustration of a part of a cylindrical-shaped heat exchanger and the associated air flow inlet/outlet paths in accordance with one embodiment of the heat exchanger apparatus of the invention.

(1) FIG. 1 is a schematic illustration of a part of a cylindrical-shaped heat exchanger and the associated air inlet/outlet paths in one of the embodiments of the heat exchanger apparatus in accordance with the invention, in which the heat exchanger has air duct inlet/outlet openings provided on its axial end sides and inner cylindrical hollow part. In the Figure, the reference numeral 1 denotes a cylindrical-shaped heat exchanger, while the numeral 2 represents an inner cylindrical hollow part which has an air duct switching section as described later. In addition, the numeral 3 denotes a separator for separating two air flows from each other. In the cylindrical-shaped heat exchanger 1 having such structure, the air flow entering the cylindrical-shaped heat exchanger 1 through one of the sides of the separator 3 comes out of the cylindrical-shaped heat exchanger 1 from the same side of the separator 3.

Figure 2:
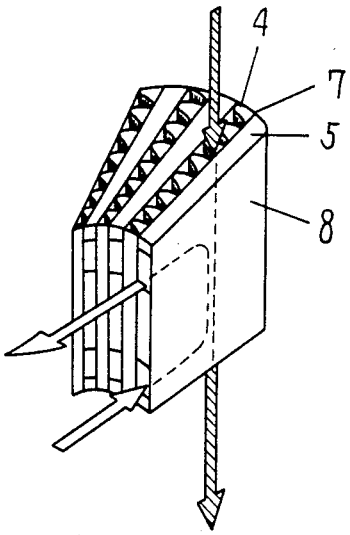
FIG. 2 is a detail view of a part of the heat exchanger shown in FIG. 1.

The cylindrical-shaped heat exchanger 1 is constructed as shown in FIG. 2. More specifically, the cylindrical-shaped heat exchanger 1 is constituted by first elements 4 and second elements 5. Each of the first elements 4 has a passage extending therethrough in the axial direction of the cylindrical-shaped heat exchanger 1. Each of the second elements 5, on the other hand, has a passage which provides communication between two openings, formed on the inner peripheral side of the cylindrical-shaped heat exchanger 1, through which air flows in and out in the radial direction of the cylindrical-shaped heat exchanger 1, which is perpendicular to the above-mentioned axial direction. The first elements 4 and the second elements 5 are laminated one upon another through partitions 7, 8 in the circumferential direction of the cylindrical-shaped heat exchanger 1.

Figure 3:
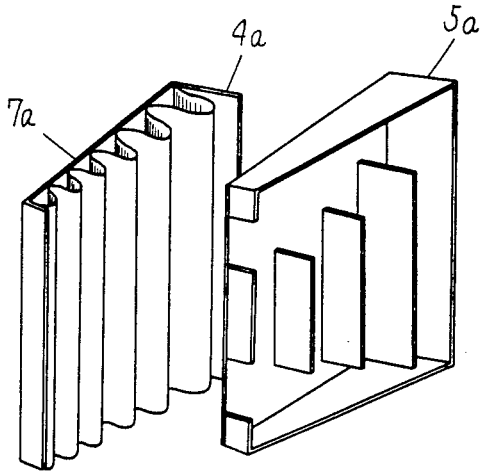
FIG. 3 is an illustration of elements constituting the heat exchanger shown in FIG. 1.

Referring now to FIG. 3 which shows an example of each of the elements constituting the cylindrical-shaped heat exchanger 1, pairs of elements 4*a*, 5*a* are alternately laminated one upon another to constitute the cylindrical-shaped heat exchanger 1. In this case, each of the elements 4*a* and 5*a* is constituted by a formed vinyl chloride plate having its surface coated with colloidal silica as a moisture absorber which is dried so as to adhere to the surface. The air flow passage in the element 4*a* extends therethrough in the axial direction of the cylindrical-shaped heat exchanger 1, while the air flow passage in the element 5*a* is so formed that air flows in from one of the openings formed on the inner peripheral side and flows out from the other opening. The reference numerals 7*a*, 8*a* denote partitions.

Figure 4:
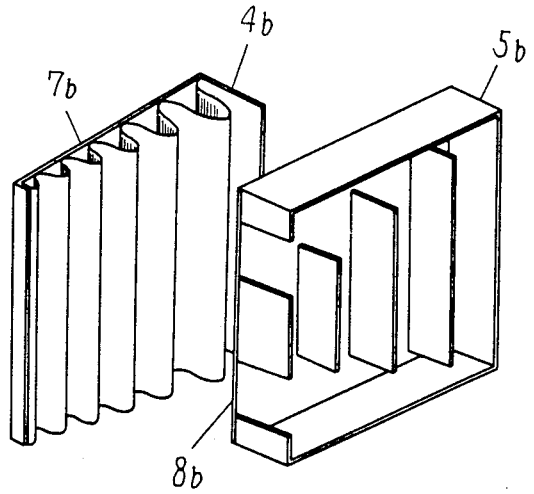
FIG. 4 is an illustration of another example of each of the elements shown in FIG. 3.

FIG. 4 shows another example of each of the elements constituting the cylindrical-shaped heat exchanger 1. The thickness of an element 4*b* is gradually changed in the radial direction, but the thickness of an element 5*b* is constant; therefore, the former has a larger air duct resistance than the latter. The reference numerals 7*b*, 8*b* denote partitions.

Figure 5:
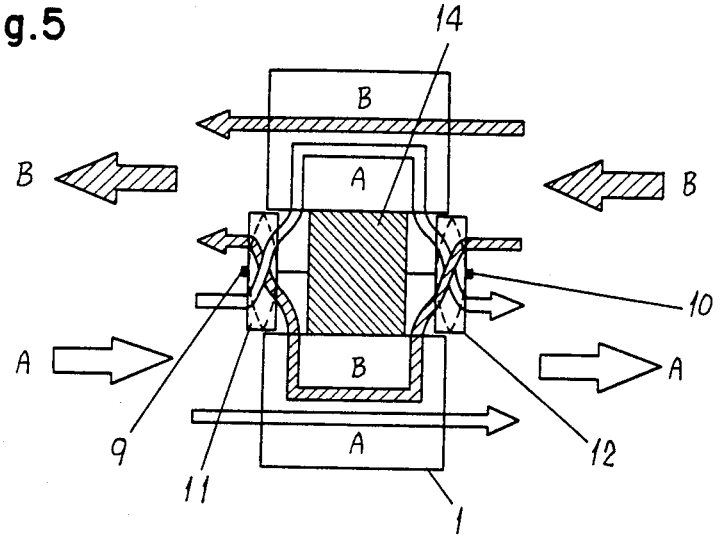
FIG. 5 is a schematic sectional view of the cylindrical-shaped heat exchanger in accordance with one embodiment of the invention.
Figure 6:
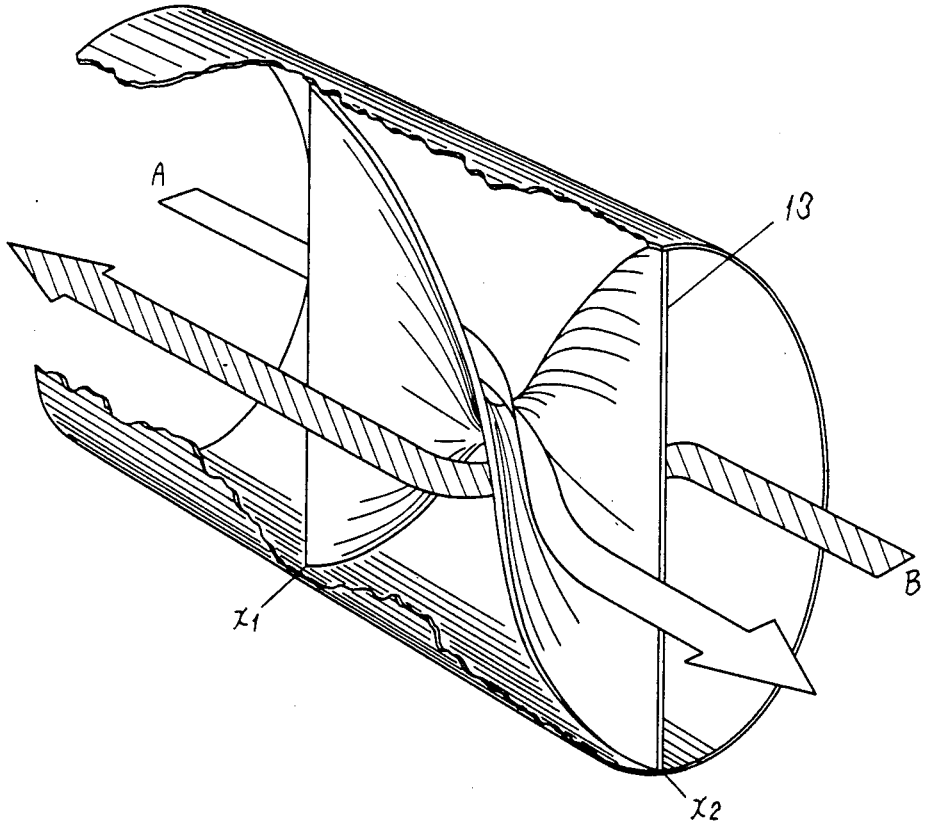
FIG. 6 is a schematic illustration of an essential part of the heat exchanger shown in FIG. 5.

FIG. 5 is a schematic sectional view of one embodiment of the invention which employs the cylindrical-shaped heat exchanger 1 of the type described above, and schematically shows how two air flows pass therethrough. In the Figure, the reference numerals 9, 10 denote separators which separate air ducts for passing two air flows entering the cylindrical-shaped heat exchanger 1. Air duct switching sections 11, 12 are respectively provided on the inlet/outlet openings of the air ducts on the inner cylindrical hollow side. Each of the air duct switching sections 11, 12 has a basic structure as shown in FIG. 6, corresponding to the section between $x_1$ and $x_2$ in the Figure. A switching plate 13 which separates the air ducts for passing two air flows is twisted 180° in the section between $x_1$ and $x_2$ in the Figure to allow the air flow ducts on both sides of the switching plate 13 to interchange with each other in this section. In such structure, the members which rotate about the axis of the cylindrical-shaped heat exchanger 1 are only the cylindrical-shaped heat exchanger 1 and a partition plate 14 which is integral with the cylindrical-shaped heat exchanger 1 and serves to prevent air from axially passing through the hollow part of the cylindrical-shaped heat exchanger 1. The separators 9, 10 and the air duct switching sections 11, 12 are fixed.

Heat is exchanged between two air flows in not only a sensible heat exchange operation mode but also a total heat exchange operation mode. More specifically, the sensible heat exchange operation is effected through the partitions 7, 8 between the adjacent first and second elements 4, 5 shown in FIG. 2. On the other hand, the total heat exchange operation is performed as shown in FIG. 5, for example. More specifically, the rotation of the cylindrical-shaped heat exchanger 1 allows primary and secondary air flows A, B to be repeatedly switched over from one to the other such that in the upper part (as viewed in FIG. 5) of the cylindrical-shaped heat exchanger 1 the secondary air flow B passes through the first elements 4 and the primary air flow A passes through the second elements 5, but in the lower part (as viewed in FIG. 5) of the cylindrical-shaped heat exchanger 1 the primary air flow A passes through the first elements 4 and the secondary air flow B passes through the second elements 5, thus causing the sensible heat and moisture accumulated in the elements by one air flow to transfer to the other air flow.

Thus, unlike the conventional regenerative rotary type heat exchanger, the heat exchanger of the invention has the advantage that the heat of adsorption generated by the adsorption of moisture by the elements, the heat of desorption generated by the desorption of moisture from the elements, or the sensible heat in a high-temperature air flow can be mostly transferred from one air flow to the other air flow not only by the rotation of the cylindrical-shaped heat exchanger but also through the partitions 7, 8 between the adjacent first and second elements 4, 5. Therefore, it is possible to increase the effective quantity of moisture adsorbed by the elements, thereby allowing an increase in efficiency. Further, the transfer of sensible heat through the partitions 7, 8 prevents the heat accumulation capacity of the elements from reaching saturation even if the cylindrical-shaped heat exchanger 1 is at rest. Accordingly, the cylindrical-shaped heat exchanger of the invention may have a lower rotational speed than the conventional regenerative rotary type heat exchanger. It has been found as the result of experiments that the optimum rotational speed of the novel heat exchanger of the invention is about 1 r.p.m, whereas the optimum rotational speed of the conventional regenerative rotary type heat exchanger is about 15 r.p.m.. This fact creates another advantage in that the level of rotary noise generated by the heat exchanger of the invention is lower than that of the conventional regenerative rotary type heat exchanger. In addition, it has been confirmed through experimental data that the heat exchanger of the invention is higher in efficiency than the conventional stationary transmission type heat exchanger. It is considered that this advantage is obtained due to the fact that although the sensible heat exchange operation is effected only by the heat conduction mechanism in the stationary transmission type heat exchanger, the sensible heat exchange operation is performed by both the heat conduction and heat accumulation mechanisms in the novel heat exchanger of the invention.

Figure 7:
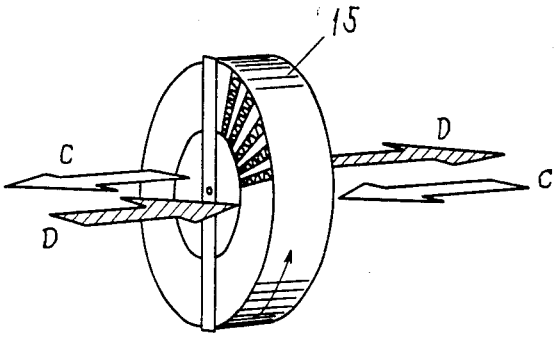
FIG. 7 is a schematic illustration of the appearance of a part of a cylindrical-shaped heat exchanger and the associated air flow inlet/outlet paths in accordance with another embodiment of the heat exchanger apparatus of the invention.
Figure 8:
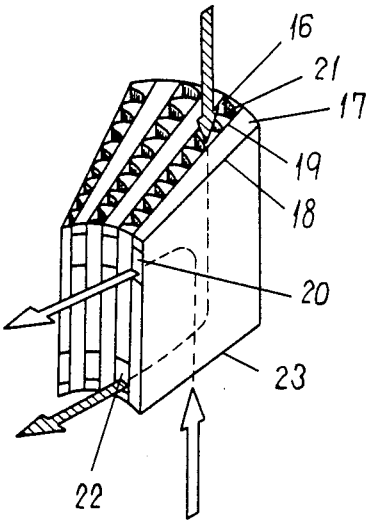
FIG. 8 is a detail view of a part of the heat exchanger shown in FIG. 7.

(2) FIG. 7 shows another embodiment of the invention which differs from that shown in FIG. 2 in air duct arrangement. In this embodiment, a cylindrical-shaped heat exchanger 15 is constructed as shown in FIG. 8. More specifically, the cylindrical-shaped heat exchanger 15 is constituted by first elements 16 and second elements 17 as shown in FIG. 8. Each of the first elements 16 has an opening 21 formed on one end side in the axial direction of the cylindrical-shaped heat exchanger 15 and an opening 22 formed in a portion thereof on the inner peripheral side closer to the other end side. On the other hand, each of the second elements 17 has an opening 23 formed on the other end side in the axial direction of the cylindrical-shaped heat exchanger 15 and an opening 20 formed in a portion thereof on the inner peripheral side closer to the one end side. The first and second elements 16, 17 are alternately laminated one upon another through partitions 18, 19 in the circumferential direction of the cylindrical-shaped heat exchanger 15.

Figure 9:
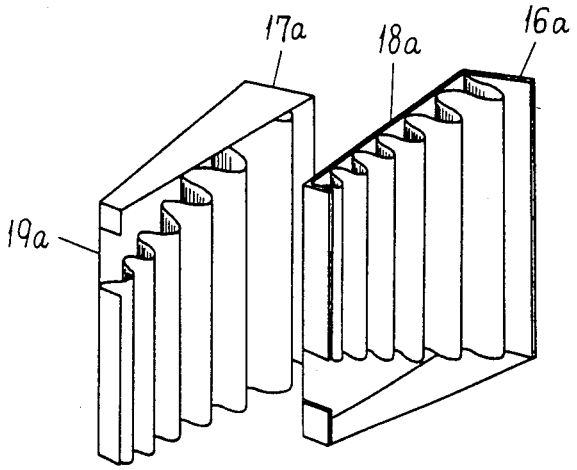
FIG. 9 is an illustration of elements constituting the heat exchanger shown in FIG. 8.

Referring now to FIG. 9 which shows an example of each of the elements constituting the cylindrical-shaped heat exchanger 15 in accordance with this embodiment, pairs of elements 16*a*, 17*a* are laminated one upon another to constitute the cylindrical-shaped heat exchanger 15. It is to be noted that the reference numerals 18*a*, 19*a* denote partitions. Each of the first and second elements 16, 17 is constituted by a vinyl chloride plate having its surface coated with $Al_2O_3$ as a moisture absorber which is dried so as to adhere to the surface. The cylindrical-shaped heat exchanger 15 constituted by the lamination of the elements 16, 17 is adapted to allow two air flows to pass therethrough while turning 90° and therefore advantageously permits the passages for both the air flows to be equal in passage resistance to each other. Thus, both the air flow passages are made equal in wind pressure to each other, thereby allowing the heat exchange efficiency by heat transfer to improve.

Figure 10:
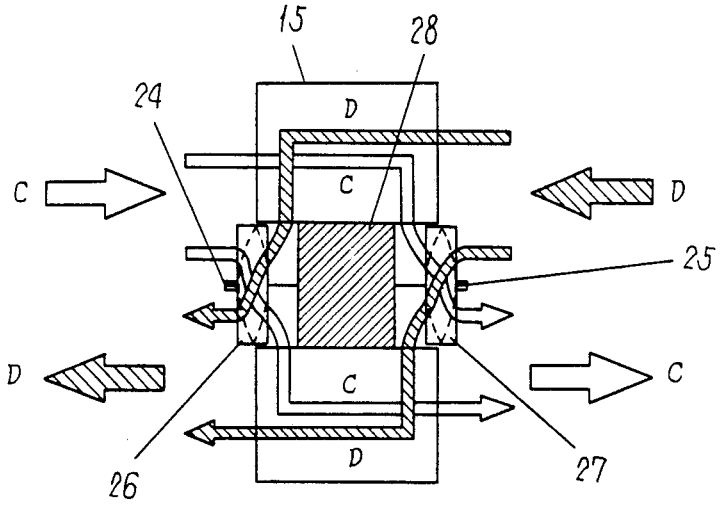
FIG. 10 is a schematic sectional view of the heat exchanger shown in FIG. 7, showing how two air flows pass therethrough.

FIG. 10 is a schematic sectional view of a heat exchanger constituted by the cylindrical-shaped heat exchanger 15 having the construction shown in FIG. 7, and schematically shows how two air flows pass through the heat exchanger. In the Figure, the cylindrical-shaped heat exchanger 15 is provided in its hollow part with a hollow plate 28 which prevents air from passing therethrough. Further, the symbols C, D respectively denote a primary air flow and a secondary air flow; the reference numerals 24, 25 represent separators similar to those shown in FIG. 5; and the numerals 26, 27 denote air duct switching sections similar to those shown in FIG. 5.

Figure 11:
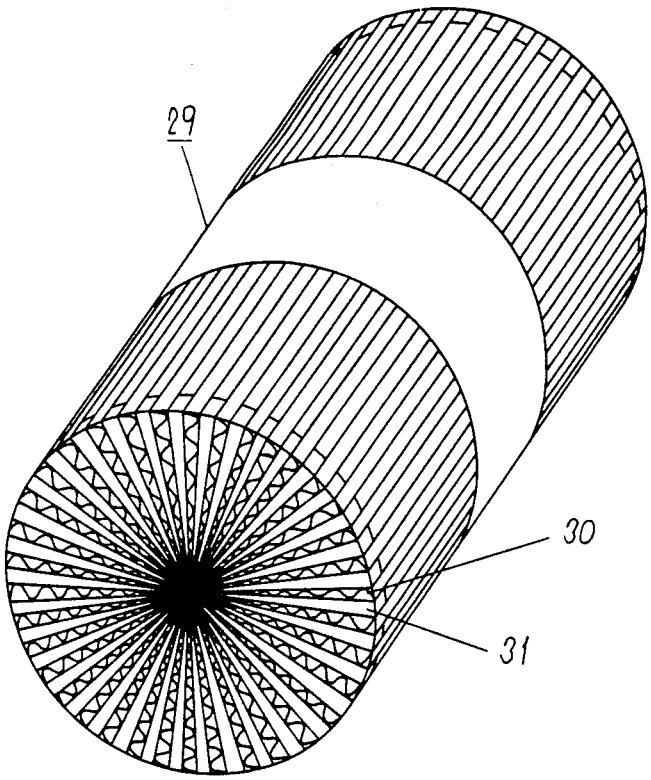
FIG. 11 is a perspective view of a cylindrical-shaped heat exchanger in accordance with still another embodiment of the heat exchanger apparatus of the invention.

(3) FIG. 11 shows a cylindrical-shaped heat exchanger 29 in accordance with one of the embodiments of the invention in which air duct inlet/outlet openings are provided on both end sides in the axial direction of the cylindrical-shaped heat exchanger 29 and the outer peripheral side thereof. First elements 30 and second elements 31 are alternately laminated one upon another to constitute the cylindrical-shaped heat exchanger 29.

Figure 12:
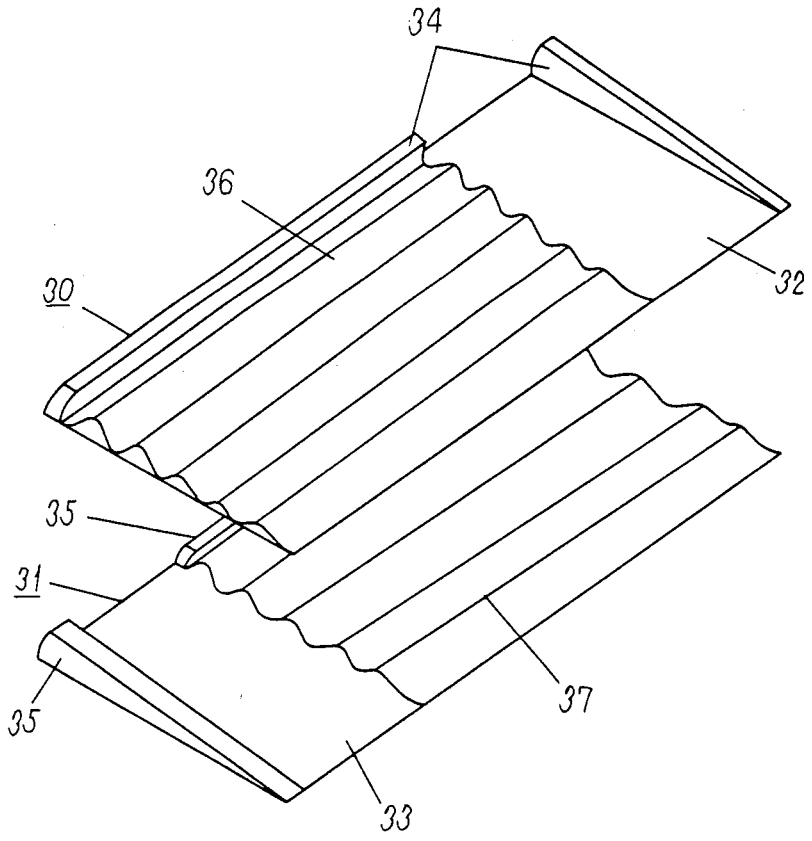
FIG. 12 is a perspective view of elements constituting the heat exchanger shown in FIG. 11.

FIG. 12 shows an example of each of the first and second elements 30, 31. The first and second elements 30, 31 are respectively composed of: partitions 32, 33 which are non-permeable to water vapor; pairs of partition plates 34, 35 each of which pairs is constituted by partition plates respectively disposed at one of the end sides in the axial direction of the cylindrical-shaped heat exchanger 29 and the outer peripheral side thereof in order to prevent the mixing of primary and secondary air flows E, F; and partition plates 36, 37 for allowing the primary and secondary air flows E, F to pass throughout the passages inside the elements. Each of the partitions and partition plates is constituted by a vinyl chloride plate having its surface coated with colloidal silica as a moisture absorber which is dried so as to adhere to the surface.

Figure 13:
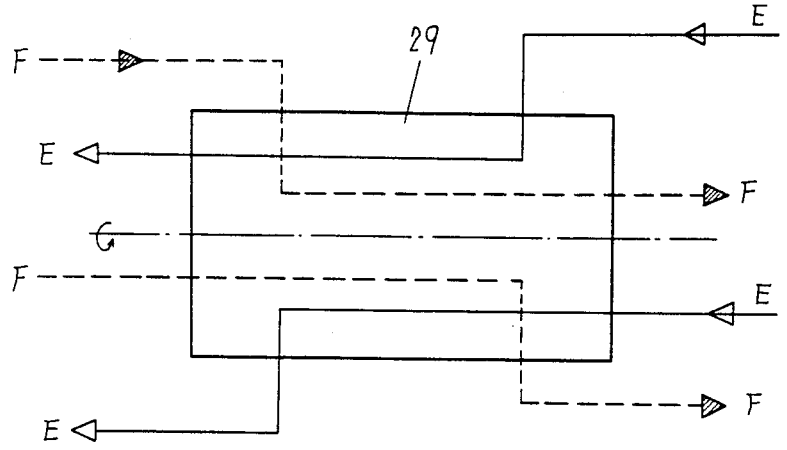
FIG. 13 is an illustration showing how to air flows pass through the heat exchanger shown in FIG. 11.

Referring now to FIG. 13 which is an illustration of air flow inlet/outlet paths inside the cylindrical-shaped heat exchanger 29, the heat exchanger 29 is completely partitioned into the upper and lower parts. In the upper part of the cylindrical-shaped heat exchanger 29, the primary air flow E enters the cylindrical-shaped heat exchanger 29 through an outer peripheral side portion thereof and comes out of the heat exchanger 29 from a left end side portion in the axial direction thereof. On the other hand, the secondary air flow F similarly enters the cylindrical-shaped heat exchanger 29 through an outer peripheral side portion thereof and comes out of the heat exchanger 29 from a right end side portion in the axial direction thereof. In the lower part of cylindrical-shaped heat exchanger 29, the primary air flow E enters the cylindrical-shaped heat exchanger 29 through a right end side portion in the axial direction thereof and comes out of the heat exchanger 29 from an outer peripheral side portion thereof. Similarly, the secondary air flow F enters the cylindrical-shaped heat exchanger 29 through a left end side portion in the axial direction thereof and comes out of the heat exchanger 29 from an outer peripheral side portion thereof.

Figure 14:
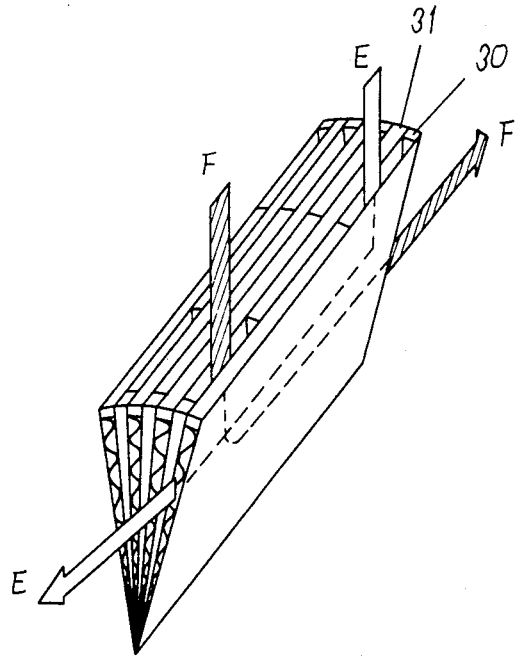
FIG. 14 is an illustration of a part of the heat exchanger shown in FIG. 11.

FIG. 14 is an illustration of a part of the cylindrical-shaped heat exchanger 29, showing how both the air flows pass through each of the elements in the upper part thereof. As illustrated, the primary air flow E enters the first element 30 through an outer peripheral side portion of the cylindrical-shaped heat exchanger 29 and passes through a passage therein which leads out from a left end side portion thereof in the axial direction of the cylindrical-shaped heat exchanger 29, and the secondary air flow F similarly enters the second element 31 through an outer peripheral side portion of the cylindrical-shaped heat exchanger 29 and passes through a passage therein which leads out from a right end side portion thereof in the axial direction of the cylindrical-shaped heat exchanger 29. Since the heat exchanger 29 is rotating, a part of the heat exchanger 29 which is shown in FIG. 14 moves so as to carry out its function as it is in the lower part of the heat exchanger 29 shown in FIG. 13. In consequence, as shown in FIG. 13, the primary air flow E enters the second element 31, through which the secondary air flow F passes when the second element 31 carries out its function as it is in the upper part of the heat exchanger 29 shown in FIG. 13, in the direction opposite to the flowing direction of the secondary air flow F, that is, through a left end side portion in the axial direction of the second element 31, and then comes out from an outer peripheral side portion thereof. On the other hand, the secondary air flow F passes through the first element 30, through which the primary air flow E passes when the first element 30 carries out its function as it is in the upper part of the heat exchanger 29 shown in FIG. 13, in the direction opposite to the flowing direction of the primary air flow E. Thus, the rotation of the elements permits the air flows respectively passing through the first and second elements 30, 31 to be interchanged with each other. This type of heat exchanger has reduced air duct resistance as compared with heat exchangers in which air passes through the hollow part thereof.

Figure 15:
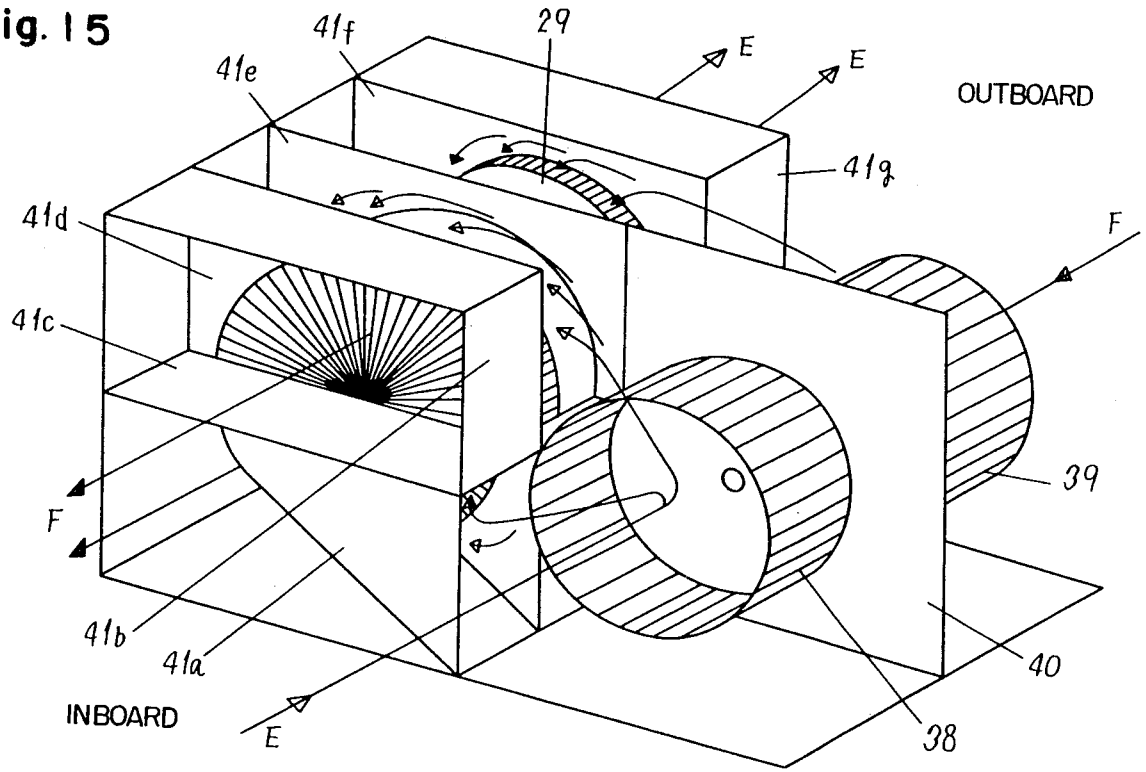
FIG. 15 is an illustration of the arrangement of a practical example of the heat exchanger apparatus employing the heat exchanger shown in FIG. 11.

FIG. 15 is an illustration of the arrangement of a practical example of an air-conditioning ventilation fan employing the cylindrical-shaped heat exchanger 29 shown in FIG. 11. The primary air flow E expelled from the indoor side to the outdoor side is passed through the passages in the heat exchanger 29 by means of an exhaust ventilating sirocco fan 38, while the secondary air flow F supplied from the outdoor side to the indoor side is passed through the passages in the heat exchanger 29 by means of a supply ventilating sirocco fan 39. Both the air flows E, F exchange heat with each other while passing through the heat exchanger 29. It is to be noted that a fan part partition plate 40 and heat exchange part partition plates 41*a* to 41*g* are provided in order to prevent mixing of the primary and secondary air flows E and F.

Such arrangement as shown in FIG. 15, in which the sirocco fans 38, 39 and the heat exchanger 29 are disposed in parallel, permits the whole structure of the heat exchanger apparatus to be reduced in longitudinal thickness and allows the manufacture thereof to be simplified. Further, since the primary air flow passage and the secondary air flow passage can be separated so as to be located at the right and left sides of the heat exchanger 29 as viewed in FIG. 15, an advantage is offered such that the primary and secondary air flows hardly mix with each other even after coming out of the ventilating fans.

Figure 16:
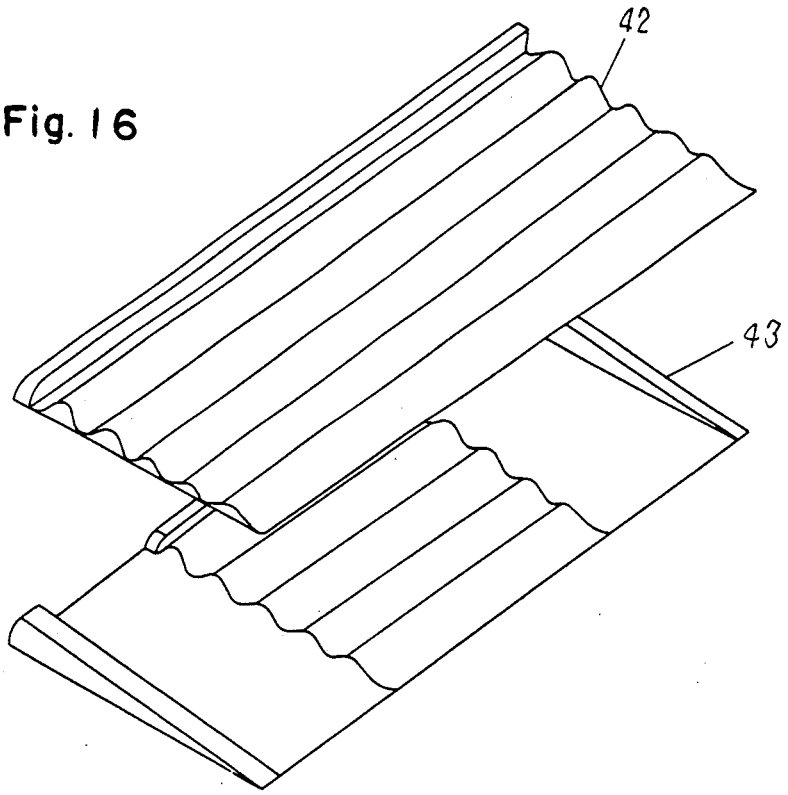
FIG. 16 is a perspective view of elements constituting a cylindrical-shaped heat exchanger in accordance with a further embodiment of the heat exchanger apparatus of the invention.
Figure 17:
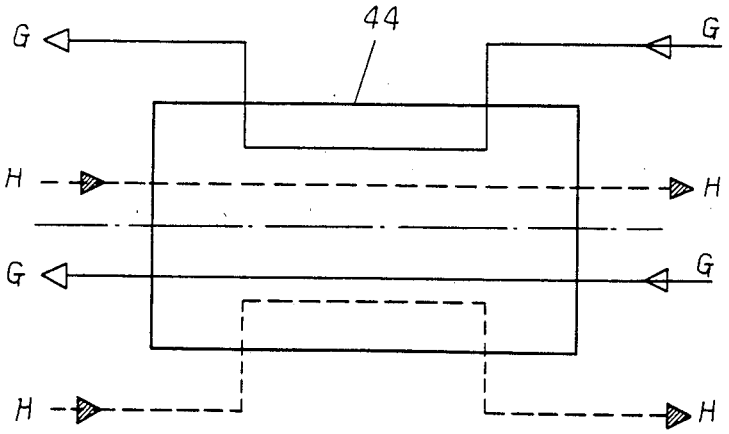
FIG. 17 is an illustration showing how two air flows pass through the heat exchanger constituted by the elements shown in FIG. 16.
Figure 18:
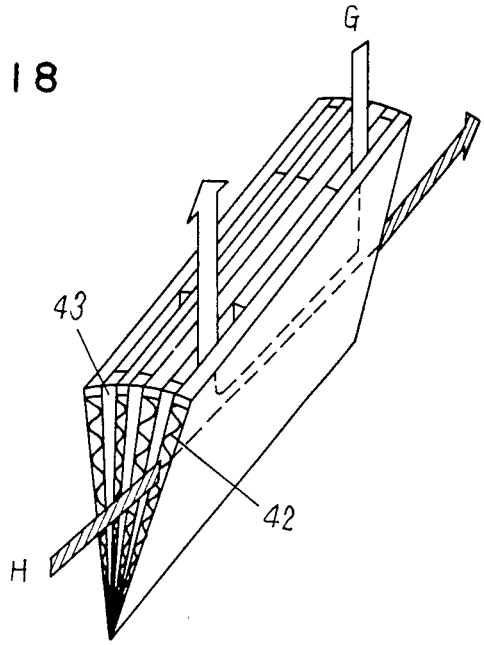
FIG. 18 is an illustration of a part of the heat exchanger constituted by the elements shown in FIG. 16.

(4) FIG. 16 shows a first element 42 and a second element 43 constituting a cylindrical-shaped heat exchanger 44 in accordance with the other of the embodiments in which air duct inlet/outlet openings are provided on both end sides in the axial direction of the cylindrical-shaped heat exchanger 44 and the outer peripheral side thereof. A primary air flow G and a secondary air flow H passing through the cylindrical-shaped heat exchanger 44 have their respective inlet/-outlet paths as shown in FIG. 17. In addition, FIG. 18 shows a part of the cylindrical-shaped heat exchanger 44.

Figure 19:
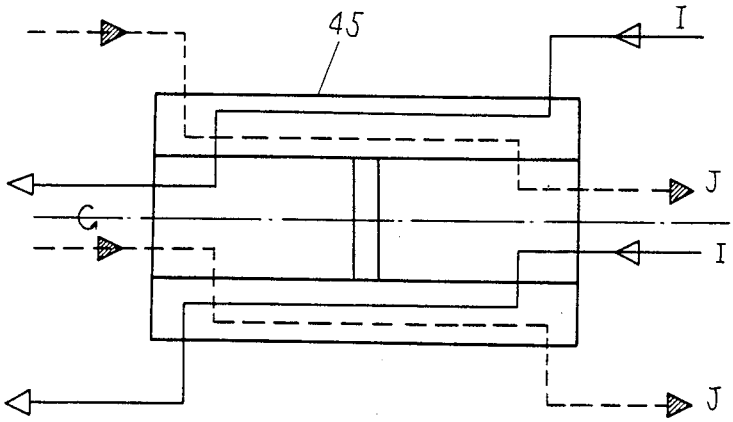
FIG. 19 is an illustration showing how two air flows pass through a heat exchanger in accordance with a still further embodiment of the heat exchanger apparatus of the invention.

(5) FIG. 19 shows inlet/outlet paths for a primary air flow I and a secondary air flow J passing through a cylindrical-shaped heat exchanger 45 in accordance with a still further embodiment of the invention. In this case, air duct inlet/outlet openings are provided on both end sides in the axial direction of the cylindrical-shaped heat exchanger 45 and the outer peripheral side thereof and further the inner peripheral side thereof.

Figure 20:
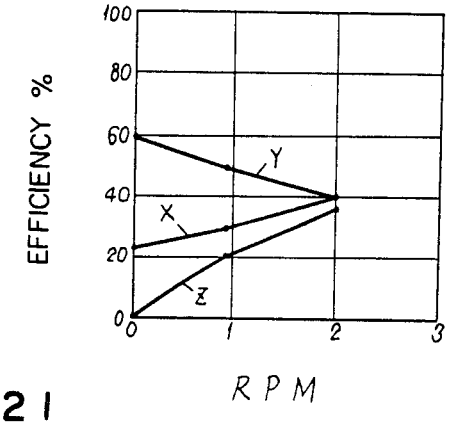
FIGS. 20 to 24 are graphs showing the heat exchanger efficiency of the heat exchanger in accordance with one of the embodiments of the invention and that of a conventional heat exchanger.
Figure 21:
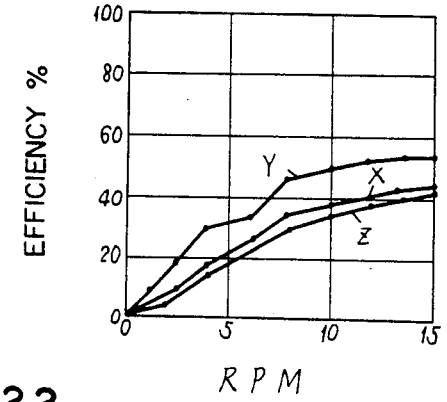

FIG. 20 is a graph showing experimental data on the heat exchange efficiency between an air flow having a temperature of 35° C., a humidity of 60% and an air flow amount of 2 $m^3$/min and an air flow having a temperature of 25° C., a humidity of 50% and an air flow amount of 2 $m^3$/min obtained by employing a heat exchanger having the construction shown in FIG. 5 and varying the number of revolutions of the rotor thereof. In the Figure, the symbols X, Y and Z respectively denote the total heat exchange efficiency, the sensible heat exchange efficiency and the latent heat exchange efficiency. As will be clear from the data in the Figure, this type of heat exchanger functions as a sensible heat exchanger when the heat exchanger is not rotated, and as the number of revolutions increases the humidity exchange efficiency lowers. This fact shows that this type of heat exchanger is made capable of coping with the need for a high level of air conditioning by changing the number of revolutions. It is to be noted that FIG. 21 shows similar experimental data in the case of the conventional regenerative rotary type heat exchanger for comparison between the heat exchange efficiencies. The conventional regenerative rotary type heat exchanger employed in the experiment had an element thereof constituted by a corrugated kraft paper wound in a rotor shape. As will be obvious from the data, in the case of the conventional regenerative rotary type heat exchanger, the percentages of the sensible heat exchange efficiency and the latent heat exchange efficiency accounting for the total heat exchange efficiency show smaller changes than those in the regenerative transmission type heat exchanger of the invention even when the number of revolutions of the rotor is changed.

Figure 22:
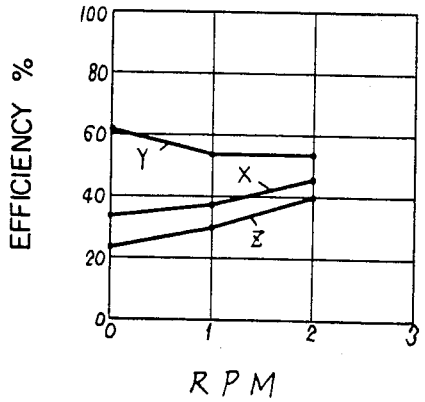

It is to be noted that although in the abovedescribed embodiments the partitions disposed in the boundaries between the adjacent first and second elements are made of a material which is non-permeable to water vapor and yet hydroscopic, such a material as a metal, a plastic or paper may be employed for the partitions. In the case of the partitions which are made of a material having permeability to water vapor, however, the heat exchanger employing such partitions effects a total heat exchange operation even when the rotation thereof is suspended. FIG. 22 shows experimental data, equivalent to those of FIG. 20, offered by a heat exchanger having the construction shown in FIG. 5 and employing kraft paper as the material for the partitions thereof.

Figure 23:
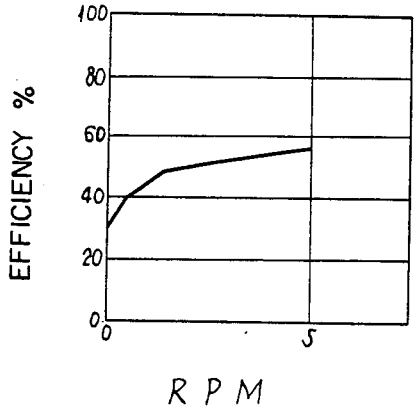

On the other hand, FIG. 23 shows experimental data on the sensible heat exchange efficiency between an air flow having a temperature of 35° C. and an air flow amount of 2 $m^3$/min and an air flow having a temperature of 25° C. and an air flow amount of 2 $m^3$/min obtained by employing a heat exchanger having the construction shown in FIG. 5 and employing as the material for the partitions thereof a hard vinyl chloride which is non-permeable to water vapor as well as non-hydroscopic, and by varying the number of revolutions of the rotor thereof.

Figure 24:
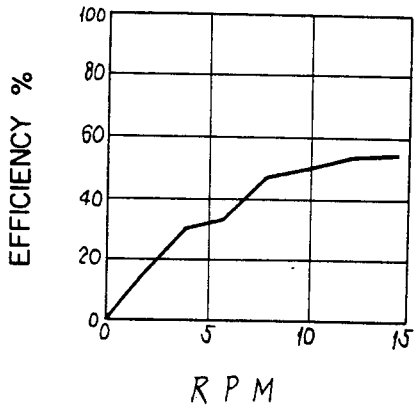

It is to be noted that FIG. 24 shows similar experimental data in the case of the conventional regenerative rotary type heat exchanger for comparison between the sensible heat exchange efficiencies. The conventional regenerative rotary type heat exchanger employed in the experiment had an element thereof constituted by a corrugated aluminum sheet wound in a rotor shape. As will be understood from these data, unlike the conventional regenerative rotary type heat exchanger, the novel heat exchanger of the invention makes it possible to obtain a high heat exchange efficiency even at a small number of revolutions.

INDUSTRIAL APPLICABILITY

As has been described, the heat exchanger apparatus of the invention provides a highly efficient heat exchanger function. In particular, it is possible to obtain a highly efficient total heat exchanger function in the case where the partitions between the adjacent heat exchanger elements are permeable to water vapor. Further, in the case where the partitions are non-permeable to water vapor and yet hygroscopic, a completely novel total heat exchange system is created and can be also utilized for air-conditioning heat recovery to a higher level.

What is claimed is:

1. A heat exchanger apparatus for exchanging heat between first and second air flows, comprising a cylindrical-shaped rotary heat exchanger having first and second end surfaces, inner and outer peripheral portions and a longitudinal axis, said heat exchanger including first and second laminated elements alternately distributed in the circumferential direction around said axis;

separator means positioned at an end surface of said rotary heat exchanger for dividing each of said first and second air flows into first and second portions; and flow passage means interposed between said separator means and said rotary heat exchanger for diverting the first portion of said first air flow through a first element of said rotary heat exchanger, the second portion of said first air flow through a second element of said heat exchanger, the first portion of said second air flow through a second element of said heat exchanger disposed adjacent the second element through which the second portion of said first air flow passes, and the second portion of said second air flow through a first element of said heat exchanger disposed adjacent the first element through which the first portion of said first air flow passes, said flow passage means merging the first and second portions of said first air flow and the first and second portions of said second air flow after passage through said rotary heat exchanger.

2. A heat exchanger apparatus according to claim 1 wherein each of said first elements has a passage extending from said first end surface of said rotary heat exchanger to said second end surface thereof in the direction of said longitudinal axis, each of said second elements has a passage extending from the inner peripheral portion at said first end surface of said heat exchanger to the inner peripheral portion at said second end surface thereof, and wherein a partition plate is provided in the inner peripheral portion of said rotary heat exchanger, said partition plate being integral with said heat exchanger.

3. A heat exchanger apparatus according to claim 1 wherein each of said first elements has a passage extending from said first end surface of said rotary heat exchanger to the inner peripheral portion at said second end surface thereof, each of said second elements has a passage extending from the inner peripheral portion at said first end surface of said heat exchanger to said second end surface thereof, and wherein a partition plate is provided in the inner peripheral portion of said rotary heat exchanger, said partition plate being integral with said heat exchanger.

4. A heat exchanger apparatus according to claim 1 wherein each of said first elements has a passage extending from said first surface of said rotary heat exchanger to the outer peripheral portion at said second end thereof in the direction of said longitudinal axis, and each of said second elements has a passage extending from the outer peripheral portion at said second end of said heat exchanger to said first and surface thereof.

5. A heat exchanger apparatus according to claim 1 wherein each of said first elements has a passage extending from said first end surface of said rotary heat exchanger to said second end thereof, and each of said second elements has a passage extending from the outer peripheral portion at said first end of said rotary heat exchanger to the outer peripheral portion thereof at said second end surface in the direction of said longitudinal axis.

6. A heat exchanger apparatus according to claim 1 wherein each of said first elements has a passage extending from the outer peripheral portion at said first end of said rotary heat exchanger to the inner peripheral portion at said second end thereof, each of said second elements has a passage extending from the inner peripheral portion at said first end of said heat exchanger to the outer peripheral portion at said second end thereof, and wherein a partition plate is provided in the inner peripheral portion of said rotary heat exchanger, said partition plate being integral with said heat exchanger.

7. A heat exchanger apparatus according to claim 1, wherein partitions are provided between the first and second elements of said heat exchanger, said partitions being nonpermeable to water vapor and at least a part thereof hygroscopic.

* * * * *

UNITED STATES PATENT AND TRADEMARK OFFICE

CERTIFICATE OF CORRECTION

PATENT NO. : 4,574,872

DATED : March 11, 1986

INVENTOR(S) : Nobuyuki Yano et al

It is certified that error appears in the above—identified patent and that said Letters Patent is hereby corrected as shown below:

In the heading of the patent, under [73], under line 2, please insert -- Matsushita Seiko Co., Ltd., Osaka, Japan --.

Signed and Sealed this

Twenty-first Day of October, 1986

[SEAL]

*Attest:*

DONALD J. QUIGG

*Attesting Officer*

*Commissioner of Patents and Trademarks*